US006637173B1

(12) United States Patent
Wheeler

(10) Patent No.: US 6,637,173 B1
(45) Date of Patent: Oct. 28, 2003

(54) APPARATUS AND METHODS OF FORMING A CURVED STRUCTURE

(75) Inventor: Frank L. Wheeler, Nicoma Park, OK (US)

(73) Assignee: Flex-Ability Concepts, L.L.C., Edmond, OK (US)

( * ) Notice: Subject to any disclaimer, the term of this patent is extended or adjusted under 35 U.S.C. 154(b) by 0 days.

(21) Appl. No.: 09/653,769

(22) Filed: Sep. 1, 2000

Related U.S. Application Data

(63) Continuation-in-part of application No. 09/459,823, filed on Dec. 13, 1999, which is a continuation of application No. 08/592,200, filed on Jan. 26, 1996, now Pat. No. 6,000,181.

(51) Int. Cl.[7] ..... E04G 21/14; E04B 2/82

(52) U.S. Cl. ..... 52/745.12; 52/241; 52/745.14

(58) Field of Search ..... 52/241, 108, 245, 52/247, 745.07, 745.12, 745.14, 274, 293.3, 745.09; 403/86, 84, 103, 104, 110

(56) References Cited

U.S. PATENT DOCUMENTS

| | | | | |
|---|---|---|---|---|
| 1,714,174 A | | 5/1929 | Lichtenberg et al. | |
| 1,901,789 A | * | 3/1933 | Wimberely | 52/108 |
| 2,269,384 A | | 1/1942 | Spinosa | |
| 2,419,321 A | * | 4/1947 | Lopes | 52/108 |
| 3,053,358 A | | 9/1962 | Gross | |
| 4,805,364 A | | 2/1989 | Smolik | |
| 4,894,962 A | | 1/1990 | Conn | |
| 5,090,170 A | | 2/1992 | Propst | |
| 5,291,717 A | | 3/1994 | Turner | |
| 5,394,665 A | | 3/1995 | Johnson | |

OTHER PUBLICATIONS

Brochure of The Flex Trim Group of Buxton Creek Industries, Bedford, Texas, entitled "The Flex Track System" (undated but admitted to be prior art).

Brochure of United States Gypsum Company entitled "Interior Remodeling Systems" (1987).

* cited by examiner

*Primary Examiner*—Michael Safavi
(74) *Attorney, Agent, or Firm*—McAfee & Taft

(57) ABSTRACT

An apparatus for forming curved structures comprises a plurality of pivotally connected sections, each section having a track portion, and a strap member adapted for slidably engaging the track portion of the sections such that the sections are movable to form a radius of curvature. A method of forming a curved structure comprises providing runners having a plurality of pivotally connected sections, each section having track portions, and each runner further having two strap members slidably engaging each of the track portions. The method also includes oppositely placing the runners in a curved position such that the runners are substantially aligned and attaching studs between the runners.

73 Claims, 7 Drawing Sheets

APPARATUS AND METHODS OF FORMING A CURVED STRUCTURE

This application is a continuation-in-part application of Ser. No. 09/459,823 filed Dec. 13, 1999, which is a continuation of Ser. No. 08/592,200, filed Jan. 26, 1996 (now U.S. Pat. No. 6,000,181).

BACKGROUND OF THE INVENTION

This invention relates generally to the field of construction and more particularly, but not by way of limitation, to apparatus and method of forming a curved structure, such as curved walls or archways, barrel ceilings and round columns.

Straight walls are typically constructed using a runner attached to the floor structure, a runner attached to the ceiling structure (or free floating) and studs positioned between and attached to the runners. The runners and studs form a structural frame to which gypsum board, such as SHEETROCK™, or other wall covering can be attached. The same principles generally apply to construction of other straight structures. The runners and studs are often formed of wood, such as 2×4's and 2×6's (approximate dimensions of boards in inches). Steel runners and studs are also used, especially in commercial construction as well as in some residential construction.

It is often desirable to construct curved structures, such as curved walls or archways, barrel ceilings and round columns. The principles for constructing curved structures are much the same as those for constructing straight structures except that the runners must form a curved shape.

Various products and methods have been used to form curved structures. One such product is demonstrated in a brochure entitled "The Flex Track™ System" sold through Flex Trim Group, a subsidiary of Burton Creek Industries, located in Bedford, Tex. This product consists of two flexible L-shaped brackets which together comprise a flexible runner to which studs can be attached. However, due perhaps to the product's design and/or flexibility, the strength of a curved structure formed using the Flex Track™ is inadequate.

A method of forming a curved wall is also illustrated in U.S. Pat. No. 5,291,717 to Turner, which is incorporated herein by reference. Turner teaches the use of a tabbed support bracket as a runner. This produces a flimsy curved structure and provides no method to lock or fix the radius of curvature.

Another method of constructing a curved wall is shown in a U.S. Gypsum Company brochure entitled "Interior Remodeling Systems," incorporated by reference herein. This method involves cutting the leg and web sections of a standard steel runner at intervals for the length of the arc. Next, a steel strip is placed inside both runners and attached with fasteners. The runners are then secured to the floor and ceiling structure and studs are fastened to the runners. This method provides adequate strength but is labor-intensive and costly, especially in a commercial setting since many cement-piercing nails must be used to secure the runner to a concrete foundation.

Thus, there is a need for improved apparatus and methods of forming a curved structure which provide adequate strength, minimal labor requirements, cost efficiency and flexibility in application.

SUMMARY OF THE INVENTION

The present invention provides improved apparatus and methods of forming a curved structure which meet the needs described above.

The apparatus for forming curved structures comprises a plurality of pivotally connected sections, each section having a first track portion, and a first strap member slidably engaging the first track portion of the sections such that the sections are movable to form a radius of curvature.

The method of forming a curved structure comprises providing a first runner and a second runner, each runner having a plurality of pivotally connected sections, each section having two oppositely positioned, generally parallel track portions, each runner further having two strap members slidably engaging each of the track portions. The method also includes oppositely placing the first runner and the second runner in a curved position such that the track portions of the first runner are substantially aligned with the track portions of the second runner and attaching a plurality of studs between the first runner and the second runner.

The present invention provides a strong curved structural support for various applications even when one runner is "floating", i.e., not attached to a structural support such as a ceiling joist. Furthermore, the present invention provides a quick, easy and cost-efficient method of constructing such a curved structure.

It is therefore a general object of the present invention to provide improved apparatus and methods of forming a curved structure. Other and further objects, features and advantages of the present invention will be readily apparent to those skilled in the art upon a reading of the following disclosure when taken in conjunction with the accompanying drawings.

BRIEF DESCRIPTION OF THE DRAWINGS

FIG. 9 is a partially sectioned view of a curved wall formed using the apparatus of the present invention.

DETAILED DESCRIPTION OF THE PREFERRED EMBODIMENTS

Figure 1:
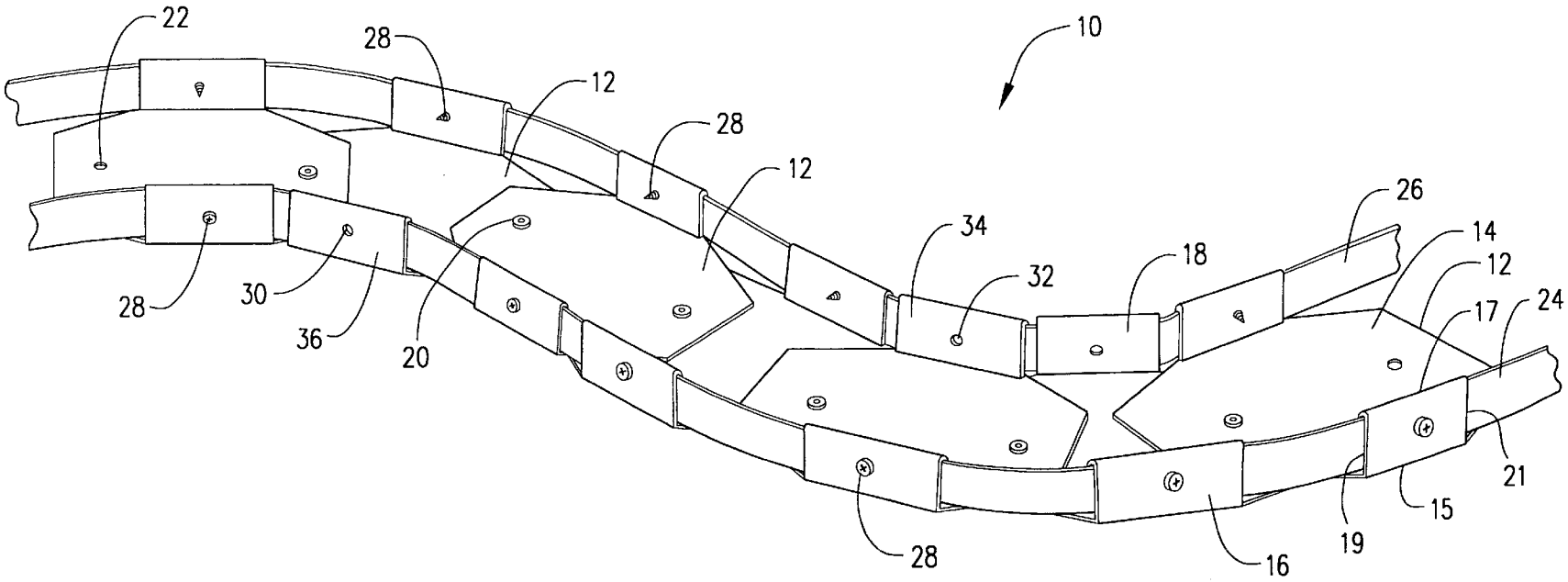
FIG. 1 is a perspective view of the apparatus of the present invention.

Referring to the drawings, presently preferred embodiments of the invention and their operation are illustrated. Like reference numerals refer to like parts throughout the drawings and this description.

Referring to FIG. 1, a presently preferred embodiment of the present invention is illustrated and generally designated by the numeral 10. Apparatus 10 is comprised of a plurality of pivotally connected sections 12. Due to its sectional structure, apparatus 10 can be constructed of virtually any length to fit the desired application.

In a preferred embodiment, each section 10 has a base portion 14, a first track portion 16 and a second track portion 18. First track portion 16 and second track portion 18 are oppositely positioned near the perimeter of base portion 14. First track portion 16 is oriented generally parallel to second track portion 18. Track portions 16, 18 are oriented generally perpendicular to base portion 14.

Track portions 16, 18 comprise proximate edge 15, which is proximate to base portion 14 and which is formed at the junction of base portion 14 and track portion 16, 18. Track portions 16 further comprise distal edge 17, which is distal in relation to base portion 14 and which, in one embodiment, is formed at the junction of inside surface 34 and outside surface 36. Track portions 16, 18 also comprise first end 19 and second end 21, which are oppositely spaced on the length of track portions 16, 18.

Adjacent sections 12 are pivotally connected by pivot means. Pivot means includes any pivotal connection 20 between adjacent sections 12. For example, pivot means includes a screw, rivet, pop rivet or brad disposed through a hole 22 in base portion 14 of a section 12 and through a hole 22 in base portion 14 in an adjacent section 12. As illustrated for example in FIGS. 1 and 2, pivot means such as pivotal connections 20 are positioned toward opposite ends of each section 12. Pivot means such as pivotal connections 20 are also centrally located. In other words, pivotal connections 20 are substantially equidistant between the sides of each section 12, i.e., between first track portion 16 and second track portion 18 in a preferred embodiment. Preferably, pivot means includes a round crimp or eyelet formed in overlapping base portions 14 of adjacent sections 12 due to the ease and cost efficiency of such means.

Apparatus 10 includes first strap member 24 which is adapted for slidably engaging first track portion 16 of sections 12. Sections 12 are laterally movable around pivotal connection 20 to form the desired radius of curvature or a variable curve. In a preferred embodiment, apparatus 10 also has a second strap member 26 which is adapted for slidably engaging second track portion 18. When one section 12 is pivoted relative an adjacent section 12, strap members 24, 26 slide relative track portions 16, 18 of a section 12.

The present invention also includes means for fixing apparatus 10 in a predetermined position. Means for fixing includes any means for locking apparatus 10 in the desired position such that adjacent sections 12 are substantially immobilized. For example, means for fixing includes screw 28 disposed through hole 30 in the outside surface 36 of a track portion 16, 18, through strap member 24, 26, and through hole 32 in the inside surface 34 of track portion 16, 18. Means for fixing also includes attaching apparatus 10 to building structure such as by nails or screws disposed through base portions 14 of sections 12, especially through overlapping base portions 14 of adjacent sections 12. Means for fixing further includes connecting overlapping base portions 14 of adjacent sections 12 such as by weld, crimp or adhesive, or by pin, screw, etc., disposed through overlapping base portions 14. Means for fixing the radius of curvature also includes crimping a track portion 16, 18 and strap member 24, 26 disposed therethrough when the radius of apparatus 10 is in the desired position.

Figure 2:
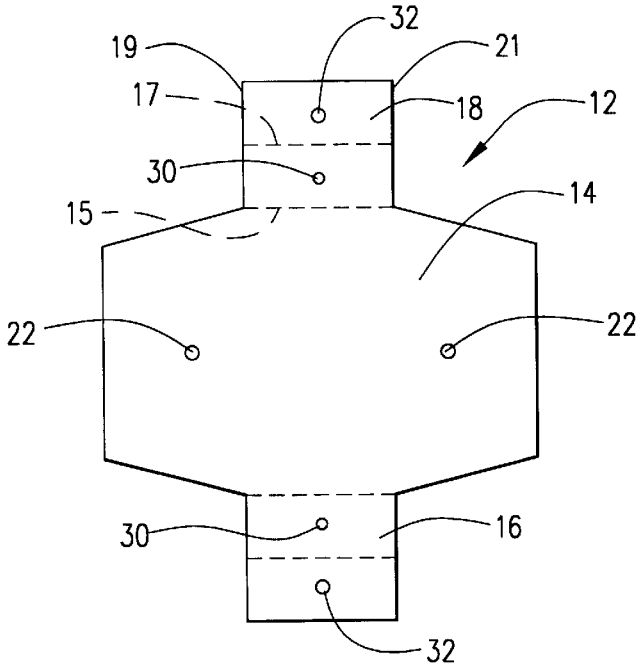
FIG. 2 is an unfolded plan view of a section of the apparatus illustrated in FIG. 1.

Hole 30 and hole 32 may be prepunched, drilled or created by the means for fixing. In a preferred embodiment, outside track hole 30 is smaller than inside track hole 32 to aid in alignment when section 12 is folded as shown in FIG. 2 during manufacture and to prevent the threads of screw 28 from pushing against or catching on the sides of the inside track hole 30. The size differential in hole. 30 and hole 32 is minimal so that the inside surface 34 of track portion 16, 18 cannot fold out over the tip of screw 28. Holes 30, 32 may also be located towards an end 19, 21 of track portion 16, 18 such that stud 46 can be subsequently positioned between track portions 16, 18 without interference by screw 28.

In addition to holes 30, 32, another hole (not shown) can be located near distal edge 17 of track portion 16, 18 such that a screw disposed through the hole for the purpose of attaching stud 46 does not interfere with strap member 24, 26. In this embodiment, the width of track portion 16, 18 is greater than the width of strap member 24, 26 to accommodate the additional hole or holes. The additional hole or holes could be separated from strap member 24, 26 by a seam, weld, crimp or other barrier.

FIG. 2 is a plan view of section 12 in an unfolded state. Section 12 can be integrally formed from a single piece of material and folded along the dotted lines to form base portion 14, first track portion 16 and second track portion 18. In a preferred embodiment, sections 12 are formed of twenty-five-gauge or heavier sheet metal. However, plastics, synthetics as well as other materials could be used to form sections 12.

Figure 3:
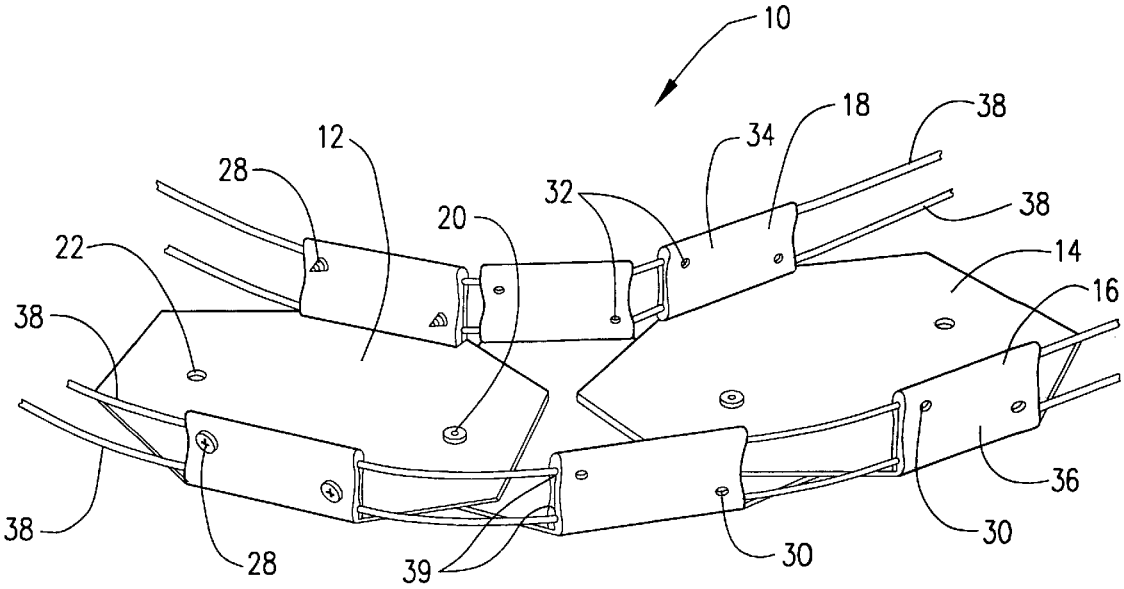
FIG. 3 is a perspective view of the apparatus with an alternate strap construction.

In an alternate embodiment shown in FIG. 3, strap means constitutes wires 38 disposed through channels 39 in track portions 16, 18. Channels 39 can be formed by a weld, crimp or other barrier. The radius of curvature of apparatus 10 can be fixed by collapsing channel 39 around wire 38 such as by crimping or by tightening screw 28. When screw 28 is used to collapse channel 39, hole 32 in inside surface 34 of track portion 16, 18 should be slightly smaller than hole 30 in outside surface 36 of track portion 16, 18 so that screw 28 will pull inside surface 34 and outside surface 36 together. The use of wires 38 in this embodiment allows a radius of curvature to be formed in multiple planes, namely the plane illustrated in FIG. 3 and a plane similar to that illustrated in an alternate embodiment in FIG. 8.

Figure 4:
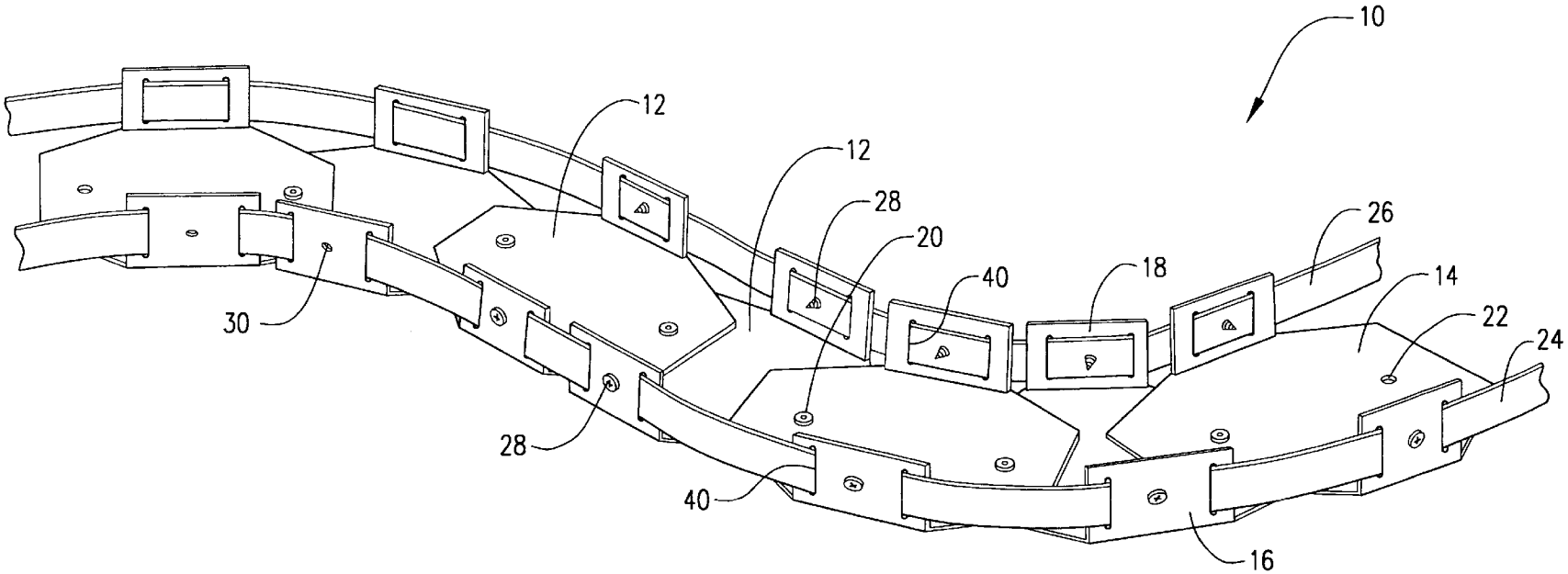
FIG. 4 is a perspective view of the apparatus with an alternate track construction.
Figure 5:
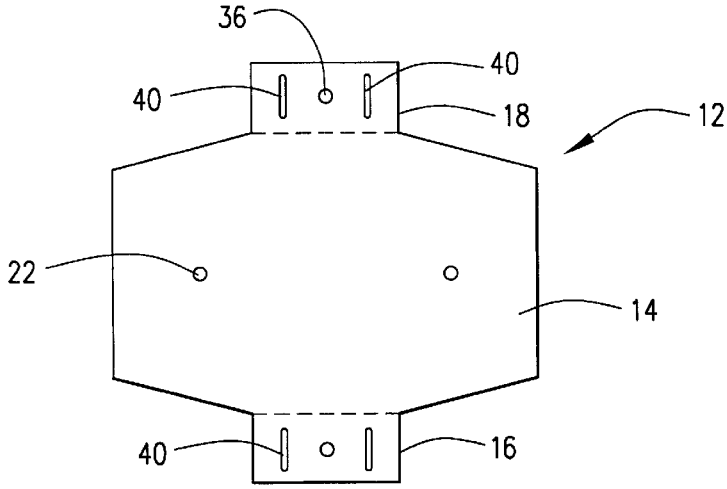
FIG. 5 is an unfolded plan view of a section of the apparatus illustrated in FIG. 4.

FIGS. 4 and 5 illustrate an alternate embodiment of track portions 16, 18. Rather than track portions 16, 18 being folded to create a channel as illustrated in FIGS. 1 and 2, FIGS. 4 and 5 illustrate that track portions 16 and 18 can be formed using slots 40. Strap means such as strap member 24, 26 or wire 38 is disposed through slots 40 such that sections 12 are pivotable by pivot means 20 to form a radius of curvature.

Figure 6:
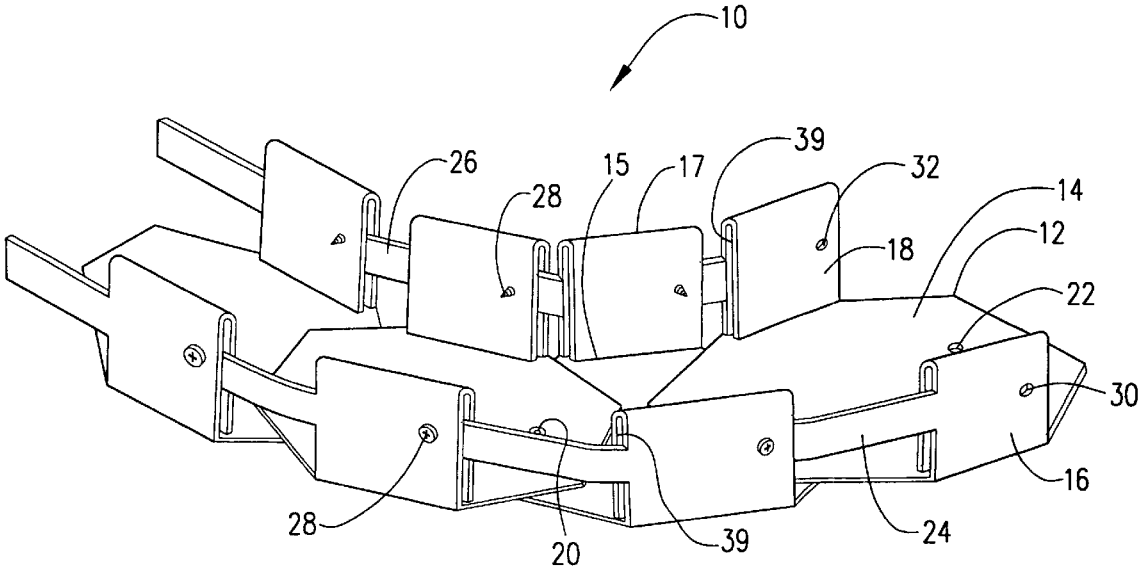
FIG. 6 is a perspective view of an alternate embodiment of the apparatus.
Figure 7:
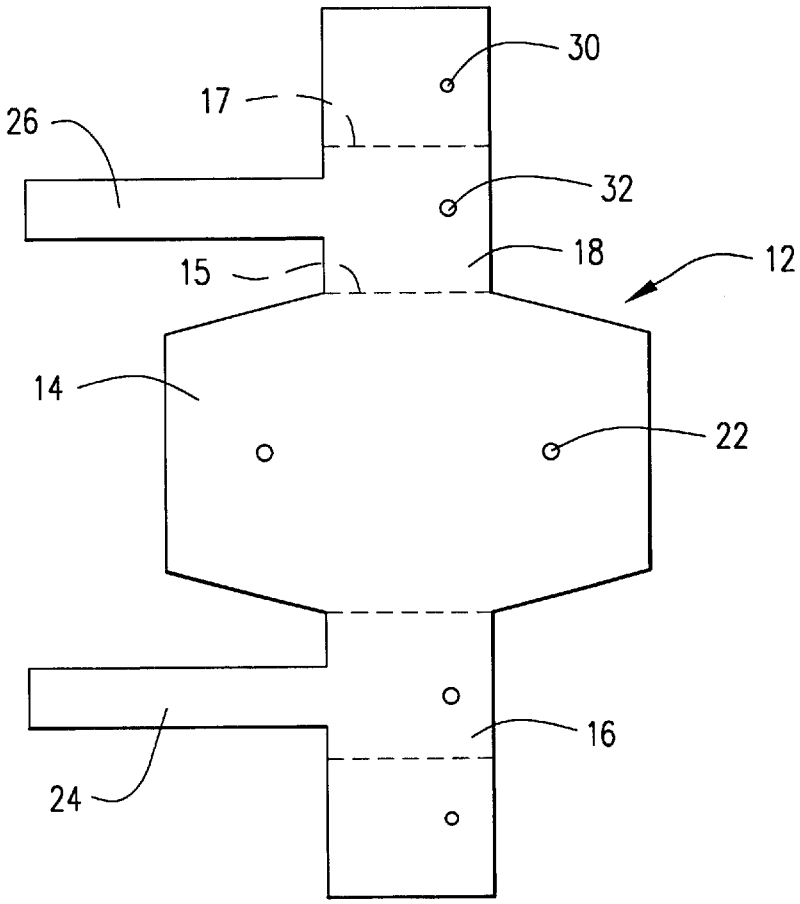
FIG. 7 is an unfolded plan view of a section of the apparatus illustrated in FIG. 6.
Figure 8:
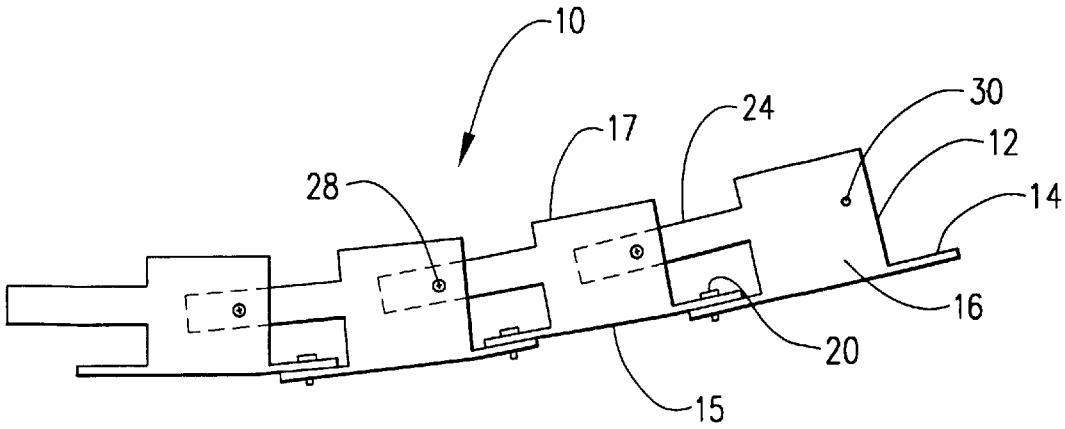
FIG. 8 is a side elevation of the apparatus illustrated in FIG. 6.

In an alternate embodiment shown in FIGS. 6, 7 and 8 strap means such as strap member 24, 26 is integrally formed with and extends from track portions 16, 18 of section 12. Strap member 24, 26 is received in channel 39 of an adjacent section 12: As shown in FIG. 7, channel 39 is created in track portions 16, 18 by folding at the dotted lines. The width of channel 39 is greater than the width of strap member 24, 26. More specifically, distal edge 17 of track portion 16, 18 is spaced apart from strap member 24, 26. This integral structure and spatial relationship permit apparatus 10 to be positioned in a radius of curvature in multiple planes, namely in the plane shown in FIG. 6 and the plane shown in FIG. 8.

FIG. 9 illustrates a curved structure formed using the method and apparatus of the present invention. Apparatus 10 provides a first runner 42 and a second runner 44. First runner 42 and second runner 44 are oppositely placed as shown in FIG. 4. Runners 42, 44 are placed in the desired curved position and the radius of curvature of each runner can be fixed or locked as previously discussed herein. Track portions 16, 18 of first runner 42 are substantially aligned with track portions 16, 18 of second runner 44. Runners 42 and 44 can be attached to building structure, i.e., as shown in FIG. 9, first runner 42 is attached to floor structure and second runner 44 is attached to ceiling structure. Runners 42, 44 can be attached to building structure for example by driving nails through base portion 14 of sections 12. The present invention will also provide good results when used to construct a curved "floating" wall, i.e., a wall in which runner 44 is not attached to ceiling or other building structure.

Studs 46 are attached between first runner 42 and second runner 44. Studs 46 may be attached, for example, by nails disposed through track portions 16, 18, through strap members 24, 26 and into studs 46. Studs 46 can be formed of wood or metal.

Once studs 46 have been attached to runners 42, 44, wall covering or gypsum board 48, such as SHEETROCK™, is attached to studs 46 using, for example, self-tapping framing screws.

Structures other than curved walls can be formed using the same method. For example, a column structure (not shown) can be formed by positioning the first runner in a circle attached to the floor structure, a second runner in a circle attached to the ceiling structure, studs attached between runners 42, 44 and gypsum board 48 attached to studs 46. Curved archways and barrel ceilings can be similarly constructed.

Figure 10:
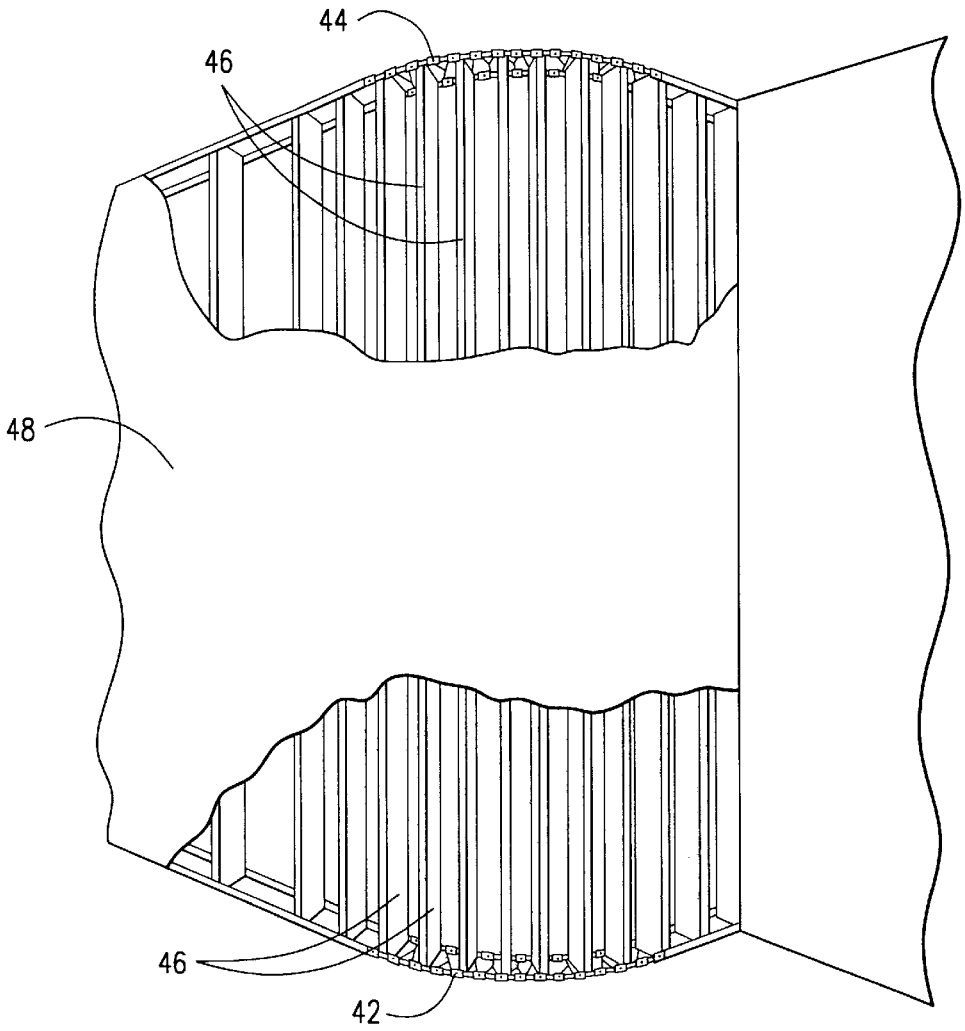
FIG. 10 is a perspective view of an alternate embodiment of the apparatus.
Figure 11:
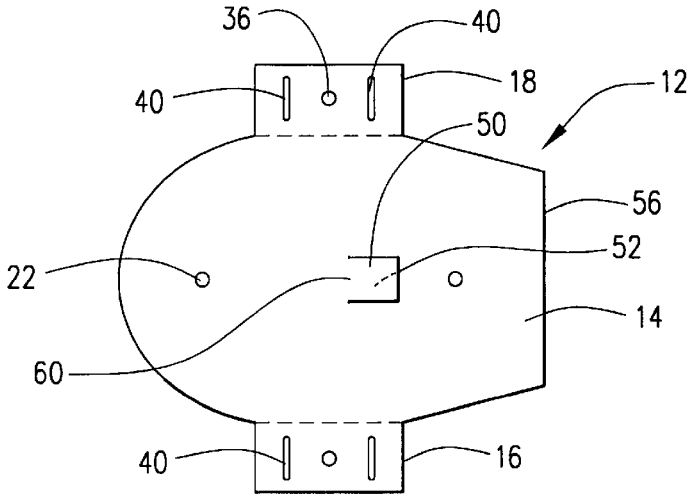
FIG. 11 is an unfolded plan view of a section of the apparatus illustrated in FIG. 10.
Figure 10:
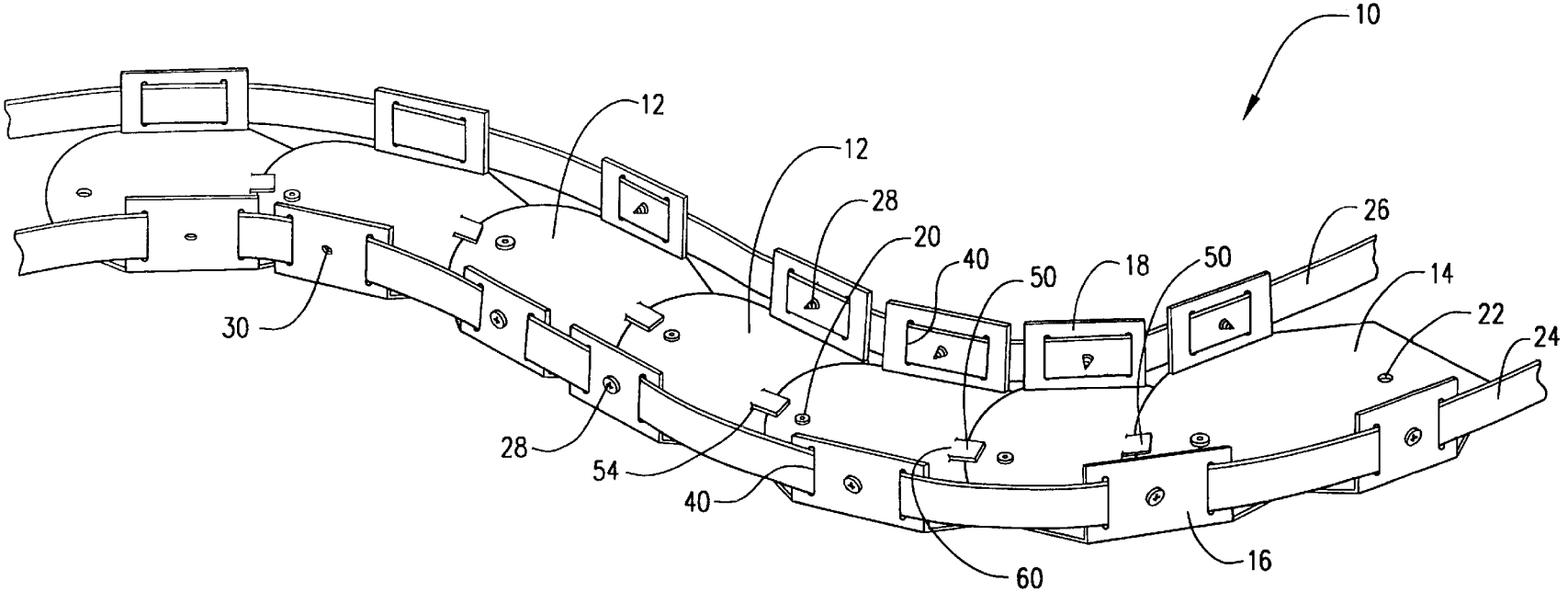

FIG. 10 provides a perspective view of another presently preferred embodiment and another preferred means for fixing apparatus 10 in a predetermined position. FIG. 11 provides an unfolded plan view of a section of the apparatus of FIG. 10. A tab 50 of base portion 14 of section 12 protrudes slightly above the horizontal plane of base portion 14. Tab 50 is preferably part of base portion 14, but may be a separate structure. A void 52 approximately the same size as tab 50 exists below tab 50 in the same plane as base portion 14. Tab 50 has a hinge portion 60 centrally located between track portions 16, 18, i.e., located approximately equidistant between track portions 16, 18. Base portion 14 has a first end 54 and a second end 56, with tab 50 positioned toward second end 56. Section 12 is pivotally connected to adjacent sections 12 such as by round crimp 58 or eyelet such that tab 50 extends over first end 54 of an adjacent section 12. First end 54 is preferably curved so that adjacent sections 12 can pivot about pivotal connection 58 without first end 54 contacting hinge portion 60 of tab 50 and limiting the range of pivotal motion between adjacent sections 12.

Tab 50 serves as a means for fixing the radius of curvature. Once apparatus 10 is in the desired position with the desired curvature, tab 50 may be struck, impacted or forced such that adjacent sections 12 are substantially immobilized, i.e., such that a section 12 is no longer pivotable relative an adjacent section 12. More specifically, tab 50 may be struck with a hammer or other blunt object causing tab 50 to move into void 52 and shear part of base portion 14 of an adjacent section. Simply compressing tab 50 against base portion 14 of an adjacent section 12, as opposed to physically shearing the material, may also act to hold the desired curvature. Preferably, apparatus 10 is a single, integral piece of sheet metal formed by a die stamping process. Apparatus 10 preferably has first track portion 16, second track portion 18, strap members 24, 26 slidably engaging the track portions 16, 18 and other features and elements previously described herein. Apparatus 10 illustrated in FIG. 10 and FIG. 11 may be used as described herein for forming curved structures such as curved walls, curved archways and barrel ceilings. In addition, apparatus 10 may be used as a cable tray or conduit for routing cable such as in the ceiling space in commercial structures and other buildings.

Thus, the present invention is well adapted to carry out the objects and attain the ends and advantages mentioned as well as those inherent therein. While preferred embodiments of the present invention have been illustrated for the purpose of the present disclosure, changes in the arrangement and construction of parts and the performance of steps can be made by those skilled in the art, which changes are encompassed within the scope and spirit of the present invention as defined by the appended claims.

What is claimed is:

1. A method of fixing the shape of a curved structure in the field of construction comprising:

providing an apparatus having a plurality of pivotally connected sections, each section having a base portion, a tab overlapping a portion of the adjacent section and a track portion extending generally perpendicular to the base portion, wherein each section further comprises:

a first track portion and a second track portion, the track portions being oppositely positioned and generally parallel such that the track portions and the base portion form a channel, the base portions of adjacent sections overlapping;

strap means slidably engaging the first track portion and the second track portion; and pivot means comprising a connection centrally located between the track portions toward each end of the base portion; and impacting the tab to restrict pivotal movement between the adjacent sections, wherein the impacting step further comprises interlocking the base portions of adjacent sections.

2. The method of claim 1 wherein the base portions of adjacent sections are pivotable in a plane parallel to the base portions.

3. The method of claim 2 wherein the strap means comprises a first strap member having a rectangular cross-section and a second strap member having a rectangular cross-section.

4. The method of claim 3 further comprising a plurality of vertical slots disposed through the first track portion and through the second track portion for receiving the first strap member and the second strap member, respectively.

5. The method of claim 4 wherein the first strap member is integrally formed with and extends from the first track portion.

6. A method of fixing the shape of a curved structure comprising:

providing an apparatus having a plurality of pivotally connected sections, each section having:

a base portion and a tab overlapping a portion of the adjacent section;

a first track portion and a second track portion, the track portions being oppositely positioned and generally parallel such that the track portions and the base portion form a channel, the base portions of adjacent sections overlapping;

strap means slidably engaging the first track portion and the second track portion; and pivot means comprising a connection centrally located between the track portions toward each end of the base portion; and impacting the tab to restrict pivotal movement between the adjacent sections by interlocking the base portions of adjacent sections.

7. An apparatus for forming curved structures in the field of construction comprising:

a plurality of sections, each of the sections having a base portion, a first track portion and a second track portion, the track portions being oppositely positioned and generally parallel such that the track portions and the base portion form a channel;

strap means slidably engaging the first track portion and the second track portion; pivot means pivotally connecting adjacent sections;

a tab that may be interlocked with the adjacent section to restrict pivotal movement between the adjacent sections, wherein the tab overlaps the base portion of the adjacent section.

8. The apparatus of claim 7 wherein the base portions of adjacent sections overlap.

9. The apparatus of claim 8 wherein the pivot means comprises a connection centrally located between the track portions toward each end of the base portion.

10. The apparatus of claim 7 wherein the tab is interlockable by impacting the tab such that the tab shears the base portion of an adjacent section.

11. The apparatus of claim 9 wherein the base portions of adjacent sections are pivotable in a plane parallel to the base portions.

12. The apparatus of claim 11 wherein the strap means comprises a first strap member having a rectangular cross-section and a second strap member having a rectangular cross-section.

13. The apparatus of claim 12 further comprising a plurality of vertical slots disposed through the first track portion and through the second track portion for receiving the first strap member and the second strap member, respectively.

14. The apparatus of claim 13 wherein the first strap member is integrally formed with and extends from the first track portion.

15. An apparatus comprising:

a plurality of sections, each of the sections having a base portion, a first track portion and a second track portion, the track portions being oppositely positioned and generally parallel such that the track portions and the base portion form a channel, and each of the sections further comprising strap means slidably engaging the first track portion and the second track portion;

pivot means pivotally connecting adjacent sections; and a tab overlapping the base portion of an adjacent section such that the tab may be interlocked with the adjacent section to restrict pivotal movement between the adjacent sections.

16. The apparatus of claim 15 wherein the base portions of adjacent sections overlap.

17. The apparatus of claim 16 wherein the pivot means comprises a connection centrally located between the track portions toward each end of the base portion.

18. The apparatus of claim 15 wherein the tab is interlockable by impacting the tab such that the tab shears the base portion of an adjacent section.

19. An apparatus comprising:

a plurality of sections, each section having a base portion and a first track portion extending perpendicular from the base portion;

a connection pivotally attached to the base portions of adjacent sections;

a first strap member having a rectangular cross-section and slidably engaging the first track portion of the sections such that the sections are movable to form a radius of curvature; and interlockable means for resisting pivotable movement between the adjacent sections.

20. The apparatus of claim 19 wherein each section further comprises a second track portion oriented generally parallel to the first track portion and generally perpendicular to the base portion such that the track portions and the base portion form a channel.

21. The apparatus of claim 20 where in the channel is adapted for receiving a stud.

22. The apparatus of claim 20 wherein the channel is adapted for receiving a cable.

23. The apparatus of claim 20 wherein the connection is centrally located between the track portions toward each end of said base portion.

24. The apparatus of claim 19 wherein the connection is attached to overlapping base portions of adjacent sections.

25. The apparatus of claim 19 wherein the interlockable means comprises a tab.

26. The apparatus of claim 25 the tab is adjacent the connection.

27. The apparatus of claim 25 wherein a force exerted on the tab shears the base portion of an adjacent section.

28. The apparatus of claim 25 wherein the tab overlaps a portion of the adjacent section.

29. The apparatus of claim 19 further comprising a vertical slot disposed through the first track portion.

30. The apparatus of claim 29 wherein the first strap member is received in the vertical slot.

31. The apparatus of claim 19 wherein the first strap member is integrally formed with and extends from the first track portion.

32. The apparatus of claim 19 wherein adjacent sections are pivotable in a plane parallel to the first track portion.

33. An apparatus comprising:

a plurality of sections, each section having a base portion;

a connection pivotally attached to the base portions of adjacent sections such that the base portions are pivotable in a plane parallel to the base portions; and a tab protruding from the base portion and overlapping a portion of the adjacent section such that an impact exerted on the tab holds a relative position of the adjacent sections.

34. The apparatus of claim 33 further comprising a first track portion.

35. The apparatus of claim 34 further comprising a first strap member slidably engaging the first track portion of the sections such that the sections are movable to form a radius of curvature.

36. The apparatus of claim 35 wherein each section further comprises a second track portion oriented generally parallel to the first track portion and generally perpendicular to the base portion such that the track portions and the base portion form a channel.

37. The apparatus of claim 35 wherein the channel is adapted for receiving a stud.

38. The apparatus of claim 35 wherein the channel is adapted for receiving a cable.

39. The apparatus of claim 36 wherein the connection is centrally located between the track portions toward each end of said base portion.

40. The apparatus of claim 33 such that the impact exerted on the tab shears the base portion of an adjacent section.

41. The apparatus of claim 33 wherein the base portion is formed of sheet metal.

42. The apparatus of claim 41 wherein the base portion and the tab are die stamped.

43. The apparatus of claim 33 wherein the base portions of adjacent sections overlap.

44. The apparatus of claim 35 further comprising a vertical slot disposed through the first track portion.

45. The apparatus of claim 44 wherein the first strap member is received in the vertical slot.

46. The apparatus of claim 45 wherein the first strap member has a rectangular cross-section.

47. The apparatus of claim 35 wherein the first strap member is integrally formed with and extends from the first track portion.

48. An apparatus comprising:

a plurality of sections, each section having a base portion and a first track portion;

a connection pivotally connecting the base portions of adjacent sections;

a tab protruding from the base portion and overlapping a portion of the adjacent section such that an impact exerted on the tab holds a relative position of the adjacent sections; and a first strap member slidably engaging the first track portion of the sections such that the sections are movable to form a radius of curvature.

49. The apparatus of claim 48 wherein each section further comprises a second track portion oriented generally parallel to the first track portion and generally perpendicular to the base portion such that the track portions and the base portion form a channel.

50. The apparatus of claim 49 wherein the channel is adapted for receiving a stud.

51. The apparatus of claim 49 wherein the channel is adapted for receiving a cable.

52. The apparatus of claim 49 wherein the connection is centrally located between the track portions toward each end of said base portion.

53. The apparatus of claim 48 such that the impact exerted on the tab shears the base portion of an adjacent section.

54. The apparatus of claim 48 wherein the base portion is formed of sheet metal.

55. The apparatus of claim 54 wherein the base portion and the tab are die stamped.

56. An apparatus comprising:

a plurality of sections, each section having a base portion and a first track portion extending perpendicular from the base portion;

a connection pivotally attached to the base portions of adjacent sections;

a first strap member slidably engaging the first track portion of the sections such that the sections are movable to form a radius of curvature; and a tab that may be interlocked with the adjacent section to restrict pivotable movement between the adjacent sections.

57. The apparatus of claim 56 wherein each section further comprises a second track portion oriented generally parallel to the first track portion and generally perpendicular to the base portion such that the track portions and the base portion form a channel.

58. The apparatus of claim 57 wherein the channel is adapted for receiving a stud.

59. The apparatus of claim 57 wherein the channel is adapted for receiving a cable.

60. The apparatus of claim 57 wherein the connection is centrally located between the track portions toward each end of said base portion.

61. The apparatus of claim 60 wherein the connection is attached to overlapping base portions of adjacent sections.

62. The apparatus of claim 56 wherein a force exerted on the tab shears the base portion of an adjacent section.

63. The apparatus of claim 56 wherein the tab overlaps a portion of the adjacent section.

64. The apparatus of claim 63 further comprising a vertical slot disposed through the first track portion.

65. The apparatus of claim 64 wherein the first strap member is received in the vertical slot.

66. The apparatus of claim 65 wherein the first strap member has a rectangular cross-section.

67. The apparatus of claim 56 wherein the first strap member is integrally formed with and extends from the first track portion.

68. An apparatus comprising:

a plurality of sections, each of the sections having a base portion, a first track portion and a second track portion, the track portions being oppositely positioned and generally parallel such that the track portions and the base portion form a channel;

pivot means pivotally connecting adjacent sections;

strap means slidably engaging adjacent sections; and a tab overlapping the base portion of an adjacent section.

69. The apparatus of claim 68 wherein the base portions of adjacent sections overlap.

70. The apparatus of claim 68 wherein the pivot means comprises a connection centrally located between the track portions toward each end of the base portion.

71. The apparatus of claim 68 wherein the tab may be interlocked by impacting the tab such that the tab shears the base portion of an adjacent section.

72. The apparatus of claim 68 wherein the adjacent sections are pivotable in a plane parallel to the base portions.

73. The apparatus of claim 68 wherein the adjacent sections are pivotable in a plane parallel to the track portions.

* * * * *